US008090284B2

(12) United States Patent
Miyahara

(10) Patent No.: US 8,090,284 B2
(45) Date of Patent: Jan. 3, 2012

(54) IMAGE FORMING APPARATUS AND PRINTING CONTROL METHOD

(75) Inventor: Norifumi Miyahara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 421 days.

(21) Appl. No.: 12/415,227

(22) Filed: Mar. 31, 2009

(65) Prior Publication Data

US 2009/0317120 A1 Dec. 24, 2009

(30) Foreign Application Priority Data

Jun. 23, 2008 (JP) ..... 2008-162756
Jun. 23, 2008 (JP) ..... 2008-162757

(51) Int. Cl.
*G03G 15/00* (2006.01)

(52) U.S. Cl. ..... 399/82; 399/87

(58) Field of Classification Search ..... 399/82, 399/87

See application file for complete search history.

(56) References Cited

U.S. PATENT DOCUMENTS 5,987,300 A * 11/1999 Mori ..... 399/87
2005/0105930 A1* 5/2005 Sakai et al. ..... 399/82
2006/0110177 A1* 5/2006 Ushio et al. ..... 399/81

FOREIGN PATENT DOCUMENTS

JP 2002-337417 11/2002

* cited by examiner

*Primary Examiner* — Ryan Walsh
(74) *Attorney, Agent, or Firm* — K&L Gates LLP

(57) ABSTRACT

Provided is an image forming apparatus comprising: mixed printing control unit that performs, in a situation where the job instruction to perform single-sided printing and the job instruction to perform double-sided printing coexist in a plurality of jobs continuously, double-sided printing process with a blank page set to be printed on one of the one side and the another side of the sheet of paper when performing printing corresponding to the job instruction to perform single-sided printing.

13 Claims, 10 Drawing Sheets

【FIG. 1】
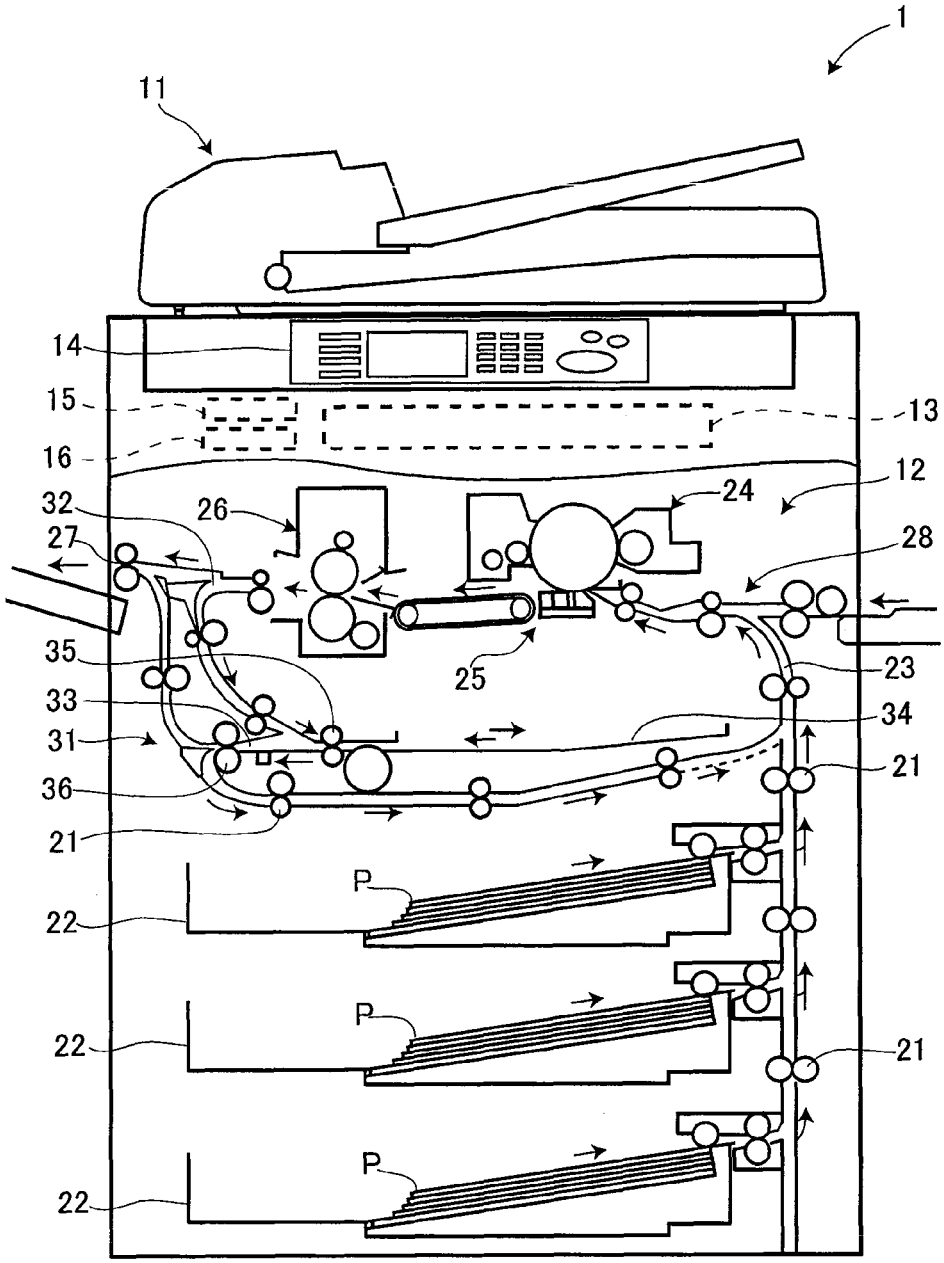

【FIG.2】
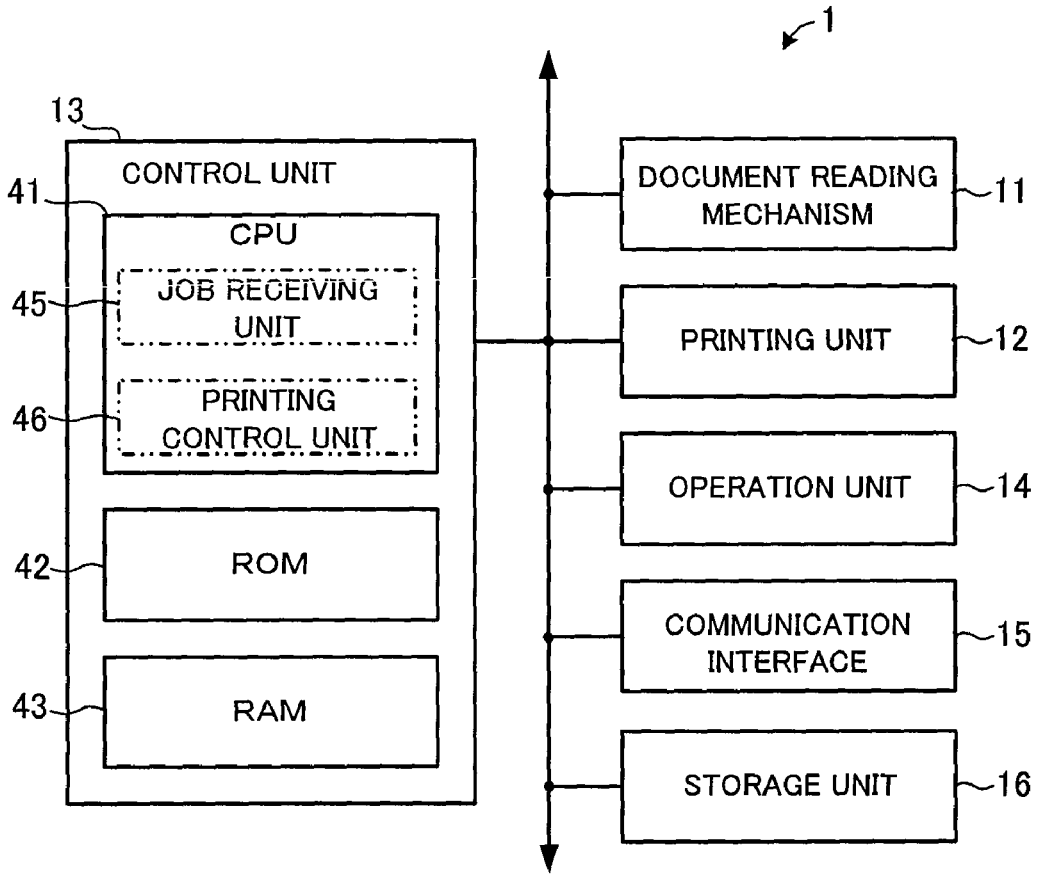

【FIG.3】
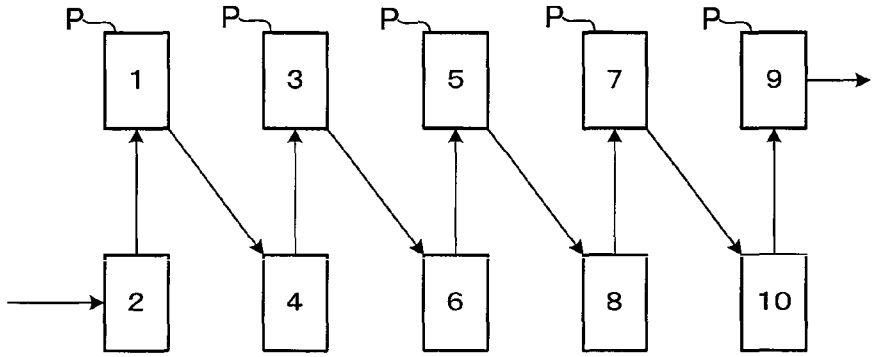
【FIG.4】
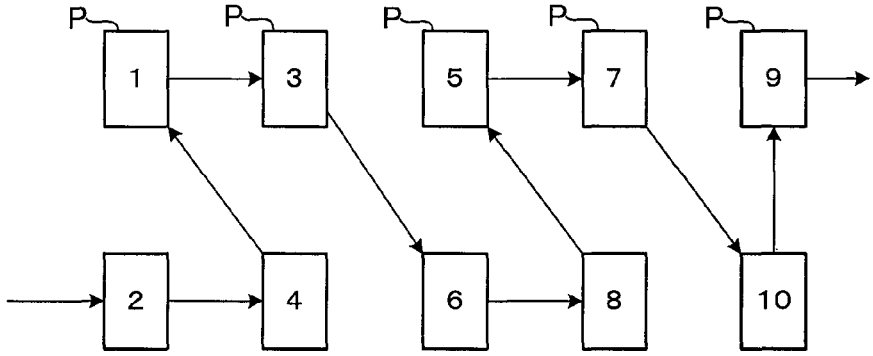
【FIG.5】
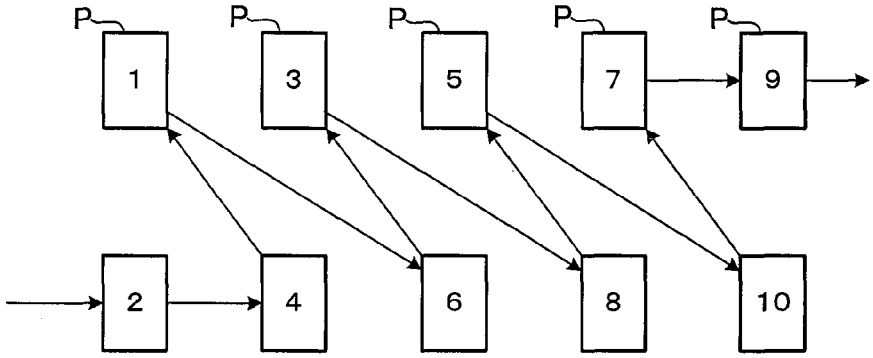

【FIG.6】
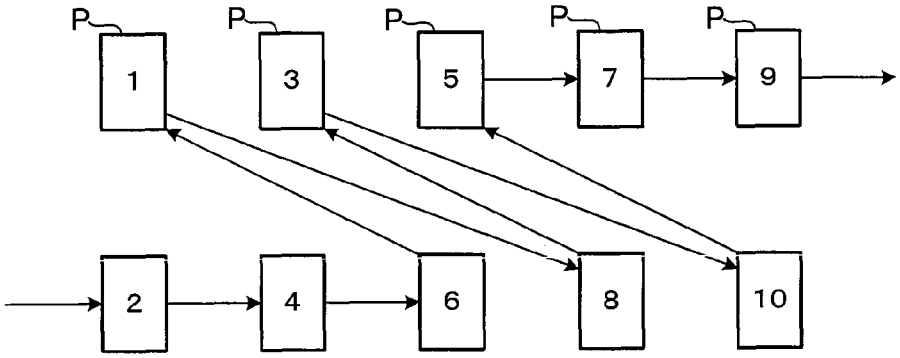
【FIG.7】
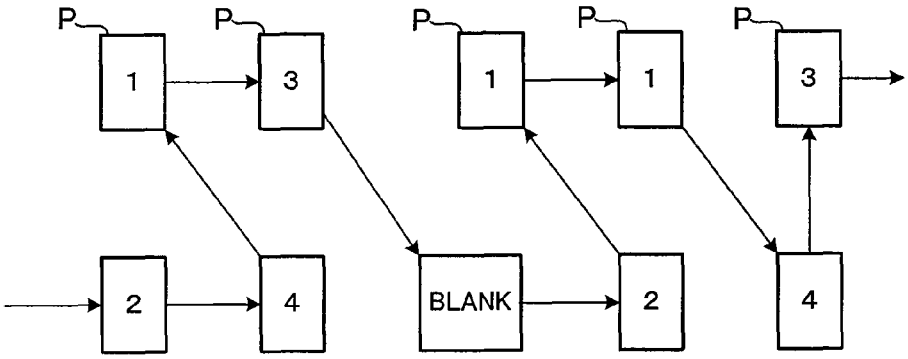
【FIG.8】
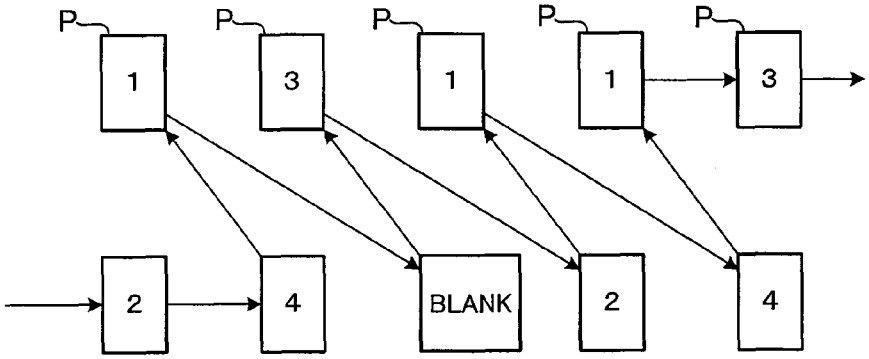

【FIG.9】
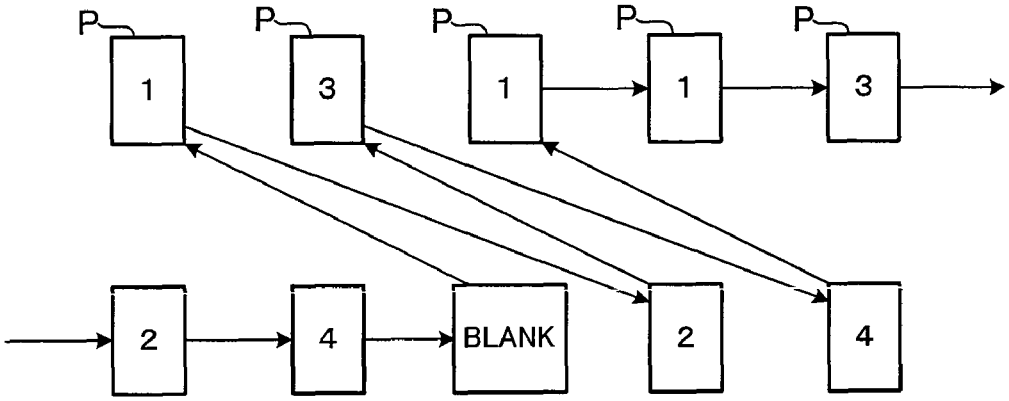

【FIG.10】
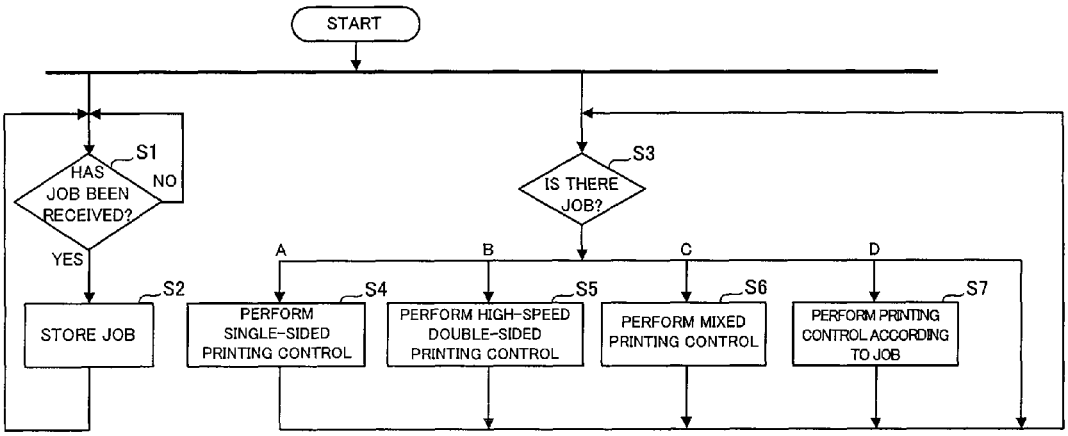

【FIG.11】
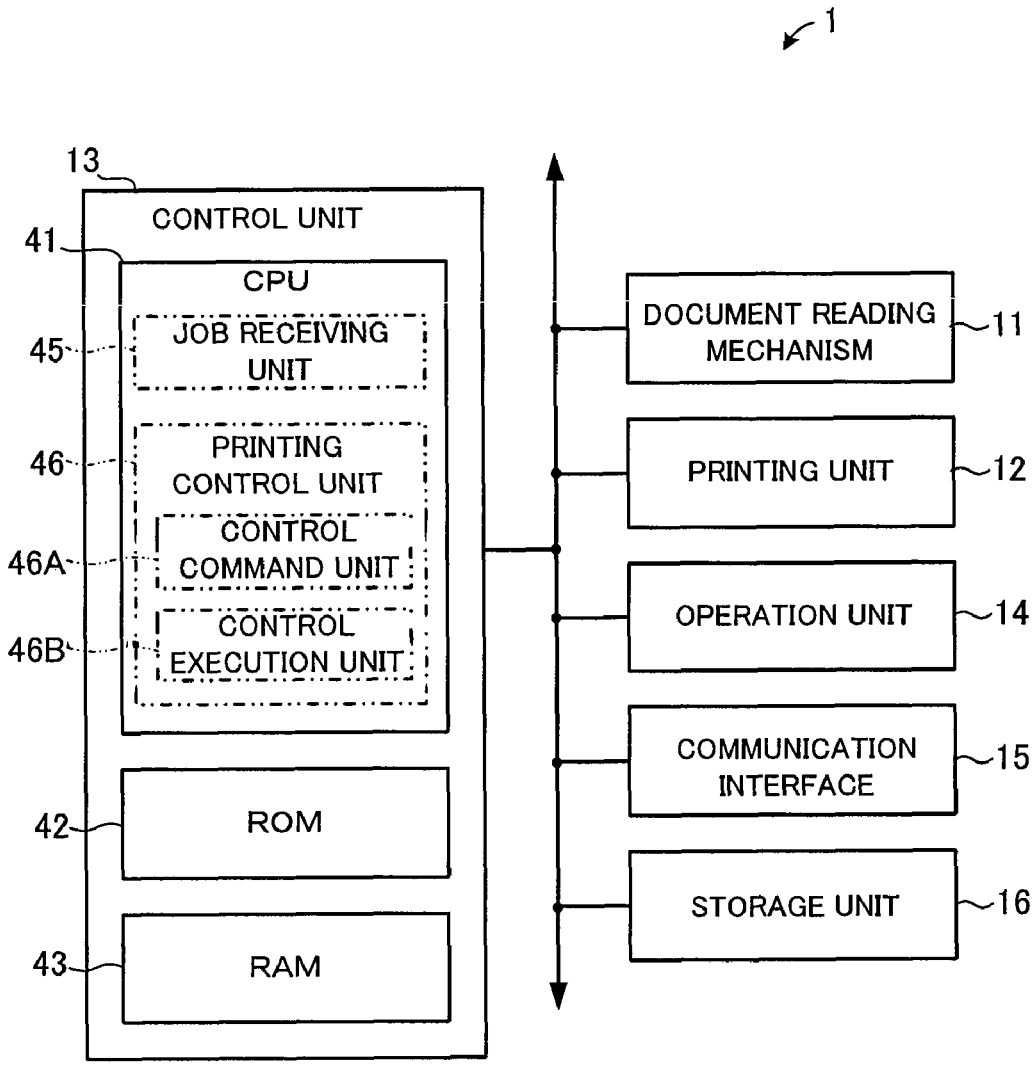

【FIG.12】

51

| IDENTIFICATION NUMBER OF PAPER SHEET SIZE/ORIENTATION | | | | | IDENTIFICATION NUMBER OF DOUBLE-SIDED PRINTING METHOD | |
|---|---|---|---|---|---|---|
| | | ⋮ | | | ⋮ | |
| 7 | ( Letter | PORTRAIT | 215.9x279.4 | [mm] ) | FIRST HIGH-SPEED DOUBLE-SIDED PRINTING | 1 |
| 8 | ( Letter | LANDSCAPE | 279.4x215.9 | [mm] ) | SECOND HIGH-SPEED DOUBLE-SIDED PRINTING | 2 |
| 9 | ( Legal | PORTRAIT | 215.9x355.6 | [mm] ) | NORMAL DOUBLE-SIDED PRINTING | 0 |
| 10 | ( A4 | PORTRAIT | 210x297 | [mm] ) | FIRST HIGH-SPEED DOUBLE-SIDED PRINTING | 1 |
| 11 | ( A4 | LANDSCAPE | 297x210 | [mm] ) | SECOND HIGH-SPEED DOUBLE-SIDED PRINTING | 2 |
| 12 | ( B5 | PORTRAIT | 182x257 | [mm] ) | FIRST HIGH-SPEED DOUBLE-SIDED PRINTING | 1 |
| 13 | ( B5 | LANDSCAPE | 257x182 | [mm] ) | SECOND HIGH-SPEED DOUBLE-SIDED PRINTING | 2 |
| 14 | ( A3 | PORTRAIT | 297x420 | [mm] ) | NORMAL DOUBLE-SIDED PRINTING | 0 |
| 15 | ( B4 | PORTRAIT | 257x364 | [mm] ) | NORMAL DOUBLE-SIDED PRINTING | 0 |
| | | ⋮ | | | ⋮ | |

【FIG.13】
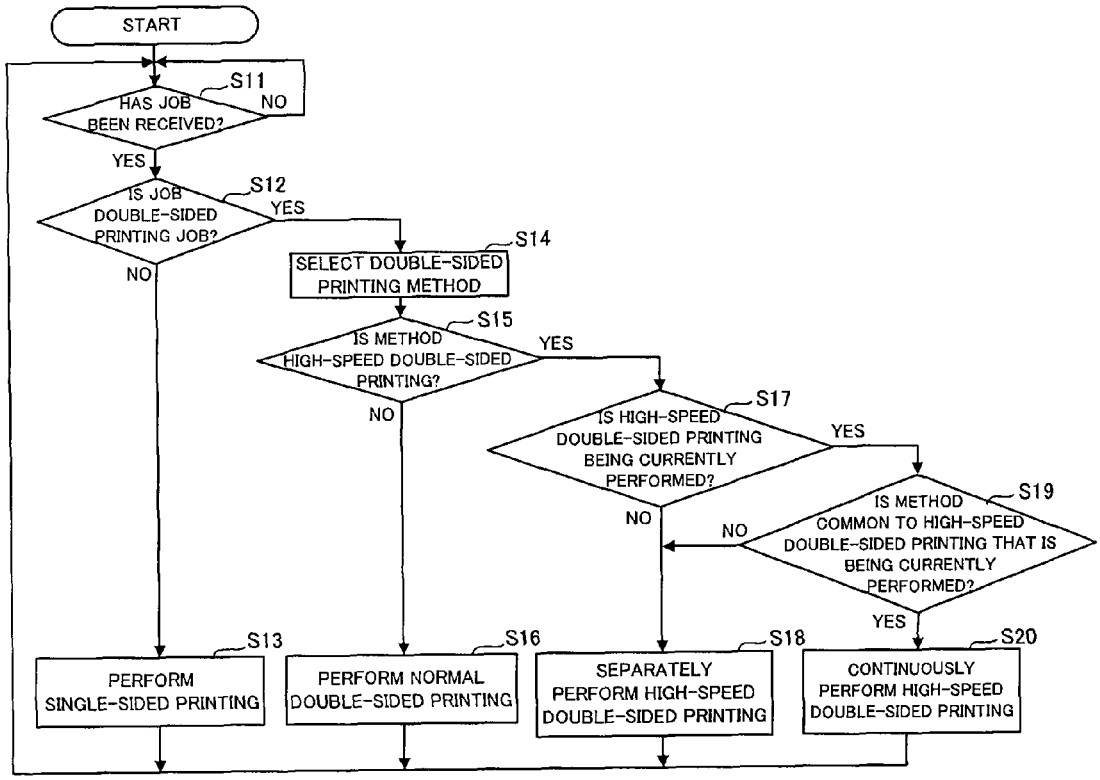

【FIG.14】
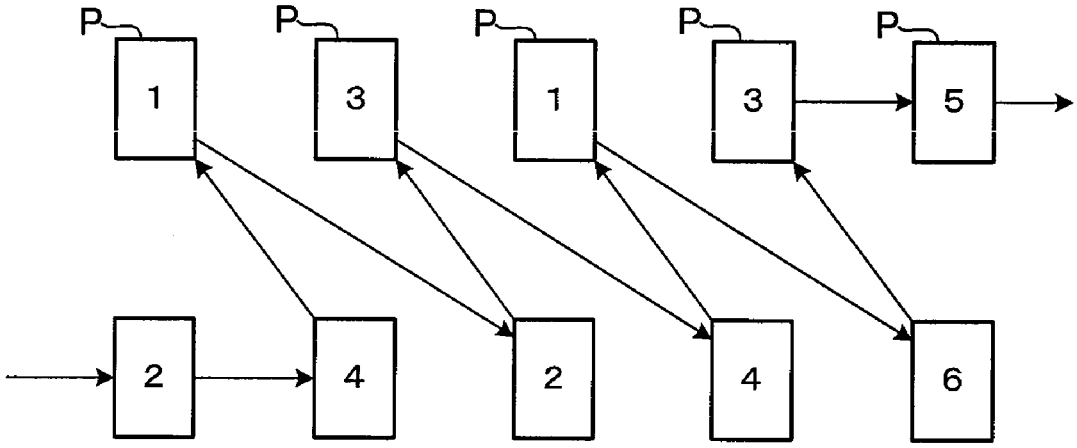

IMAGE FORMING APPARATUS AND PRINTING CONTROL METHOD

INCORPORATION BY REFERENCE

This application is based upon and claims the benefit of priority from the corresponding Japanese Patent Application No. 162756, filed Jun. 23, 2008, and No. 2008-162757, filed Jun. 23, 2008, the entire contents of which is incorporated herein by reference.

BACKGROUND

1. Field of the Invention

The present invention relates to an image forming apparatus having a high-speed double-sided printing function, such as a copier, a printer, or a multifunction peripheral, and to a method of controlling printing therefor.

2. Description of the Related Art

Presently, image forming apparatuses with double-sided printing functions, such as a copier, a printer, or a multifunction peripheral are in widespread use. Examples of double-sided printing methods for providing a double-sided printing function include normal double-sided printing and high-speed double-sided printing.

Normal double-sided printing is a method of achieving double-sided printing on a sheet of paper by continuously performing printing on one side of one sheet of paper and printing on the other side of the same sheet of paper. For example, in normal double-sided printing, the printing is performed by first printing an image of the second page on a back surface (first printing surface) of the first sheet of paper, then printing an image of the first page on a front surface (the last printing surface) of the first sheet of paper, then printing an image of a fourth page on the back surface of a second sheet of paper, and then printing an image of a third page on the front surface of the second sheet of paper.

High-speed double-sided printing is a method of performing double-sided printing on two or more sheets of paper in parallel by printing on one surface of one sheet of paper and then printing on the other surface of the sheet of paper, between which printing on both sides of another sheet of paper is performed. For example, in high-speed double-sided printing, the double-sided printing is performed by first printing the image of the second page on the back surface of the first sheet of paper, then printing the image of the fourth page on the back surface of the second sheet of paper, then printing the image of the first page on the front surface of the first sheet of paper, then printing the image of the sixth page on the back surface of a third sheet of paper, then printing the image of the third page on the front surface of the second sheet of paper, then printing the image of the eighth page on the back surface of a fourth sheet of paper, and then printing the image of the fifth page on the front surface of the third sheet of paper.

According to the high-speed double-sided printing, the time necessary to complete the printing process can be reduced by providing an overlap between the operating period for transporting a sheet of paper to a print engine while reversing the back surface and the front surface thereof and the operating period for performing printing on the back surface or the front surface of another sheet of paper, and the double-sided printing can be performed at a higher speed than the normal double-sided printing.

When high-speed double-sided printing is performed, the sheet of paper whose back surface has been printed on is kept on a paper sheet transport path. This point can be described by taking the example of the above-described high-speed double-sided printing. In high-speed double-sided printing, while printing on the back surface of the second sheet of paper, the first sheet of paper whose back surface has been printed on is kept on the paper sheet transport path. In addition, while the printing on the front surface of the first sheet of paper and on the back surface of the third sheet of paper are being performed, the second sheet of paper whose back surface has been printed on is stored on the paper sheet transport path. In addition, while the printing on the front surface of the second sheet of paper and on the back surface of the fourth sheet of paper are being performed, the third sheet of paper whose back surface has been subjected to the printing is stored on the paper sheet transport path.

Then, immediately before the high-speed double-sided printing is finished, all of the sheets of paper stored on the paper sheet transport path are delivered, and printing is performed on the front surfaces of the sheets of paper delivered from the paper sheet transport path, completing the high-speed double-sided printing.

However, in a situation where: the first high-speed double-sided printing is performed according to one job instruction to perform double-sided printing; single-sided printing is then performed according to a job instruction to perform single-sided printing; and the second high-speed double-sided printing is then performed according to another job instruction to perform double-sided printing, the image forming apparatus finishes the first high-speed double-sided printing first before performing the single-sided printing, and performs the second high-speed double-sided printing after finishing the single-sided printing. Therefore, the printing speed is greatly reduced compared to the situation where the first high-speed double-sided printing and the second high-speed double-sided printing are continuously performed (without the intermediate step of the single-sided printing).

Further, in a situation where: the image forming apparatus continuously receives two jobs of double-sided printing; and the two jobs are different from each other due to the size or orientation of the sheets of paper specified by the jobs, the image forming apparatus does not continuously perform the high-speed double-sided printing based on one job and the high-speed double-sided printing based on the other job. This is because the method for the high-speed double-sided printing differs depending on the size or orientation of the sheets of paper.

SUMMARY

An image forming apparatus according to an embodiment of the present invention comprises:

a printing unit that prints on one side and/or another side of a sheet of paper;

a job receiving unit that receives a job instruction to perform single-sided printing and/or a job instruction to perform double-sided printing;

a high-speed double-sided printing control unit that performs a double-sided printing process on two or more sheets of paper in parallel by performing printing on the one side of one sheet of paper and printing on the other side of the sheet of paper between which printing on the sides of another sheet of paper is performed; and a mixed printing control unit that performs, in a situation where the job instructing it to perform the single-sided printing and the job instructing it to perform the double-sided printing coexist in a plurality of jobs that are received by the job receiving unit, the double-sided printing process with a blank page set to be printed on either one side or the other side of the sheet of paper when corresponding to the job instruction to perform single-sided printing.

Further, a method of controlling printing according to the present invention comprises:

a job receiving step for receiving a job instruction to perform single-sided printing and/or a job instruction to perform double-sided printing;

a high-speed double-sided printing step for performing a double-sided printing process on two or more sheets of paper in parallel by printing on one side of one sheet of paper and printing on the other side of the sheet of paper between which printing on at least one side of another sheet of paper is performed; and a mixed printing step for performing, in a situation where the job instruction to perform the single-sided printing and the job instruction to perform the double-sided printing coexist in a plurality of jobs that are received in the job receiving step, the double-sided printing process with a blank page set to be printed on either one side or the other side of a sheet of paper when printing corresponding to the job instruction to perform the single-sided printing.

An image forming apparatus according to another embodiment of the present invention comprises:

a printing unit that performs double-sided printing on a plurality of sheets of paper that are different from each other in size and/or orientation thereof;

a printing request receiving unit that receives a double-sided printing request containing a specification information item for specifying the size and/or the orientation of the sheet of paper to which the double-sided printing is performed;

a storage unit that stores therein a printing control table in which a double-sided printing method corresponding to the size and the orientation of the sheet of paper is recorded; and a printing control unit that references the printing control table to select therefrom the double-sided printing method corresponding to one of the size and the orientation of the sheet of paper specified by the specification information item contained in the double-sided printing request received by the printing request receiving unit, and controls the printing unit based on the selected double-sided printing method.

Additional features and advantages are described herein, and will be apparent from the following Detailed Description and the figures.

BRIEF DESCRIPTION OF THE FIGURES

In the accompanying drawings:

FIG. 1 is a partial cutaway view illustrating an image forming apparatus according to embodiments of the present invention;

FIG. 2 is a block diagram illustrating an internal configuration of a control unit of the image forming apparatus according to an embodiment of the present invention;

FIG. 3 is an explanatory diagram illustrating normal double-sided printing;

FIG. 4 is an explanatory diagram illustrating high-speed double-sided printing for performing double-sided printing on two sheets of paper in parallel;

FIG. 5 is an explanatory diagram illustrating high-speed double-sided printing for performing double-sided printing on three sheets of paper in parallel;

FIG. 6 is an explanatory diagram illustrating high-speed double-sided printing for performing double-sided printing on five sheets of paper in parallel;

FIG. 7 is an explanatory diagram illustrating mixed printing based on the high-speed double-sided printing illustrated in FIG. 4 according to an embodiment of the present invention;

FIG. 8 is an explanatory diagram illustrating mixed printing based on the high-speed double-sided printing illustrated in FIG. 5 according to an embodiment of the present invention;

FIG. 9 is an explanatory diagram illustrating mixed printing based on the high-speed double-sided printing illustrated in FIG. 6 according to an embodiment of the present invention;

FIG. 10 is a flowchart illustrating the operation of the image forming apparatus according to an embodiment of the present invention;

FIG. 11 is a block diagram illustrating an internal configuration of the control unit of the image forming apparatus according to another embodiment of the present invention;

FIG. 12 is an explanatory diagram illustrating a printing control table according to another embodiment of the present invention;

FIG. 13 is a flowchart illustrating the operation of the image forming apparatus according to another embodiment of the present invention; and FIG. 14 is an explanatory diagram illustrating high-speed double-sided printing continuously performed based on two double-sided printing jobs according to another embodiment of the present invention.

DETAILED DESCRIPTION

FIG. 1 illustrates an image forming apparatus according to the embodiments of the present invention. As illustrated in FIG. 1, an image forming apparatus 1 is a multifunction peripheral having, for example, a copier function and a printer function, and includes a document reading mechanism 11, a printing unit 12, a control unit 13, an operation unit 14, a communication interface 15, and a storage unit 16.

The document reading mechanism 11 is a mechanism for reading an original, and is located at an upper portion of the image forming apparatus 1. The printing unit 12 is a unit for performing printing on either or both of a front surface and a back surface of a sheet of paper P, and is located inside the image forming apparatus 1. The printing unit 12 prints on the sheet of paper P an image of the original read by the document reading mechanism 11 or an image related to print data transmitted from a terminal device such as a personal computer that is connected to the image forming apparatus 1. The control unit 13 is a unit for controlling the document reading mechanism 11, the printing unit 12, and the like, and is located inside the image forming apparatus 1. The operation unit 14 is located on a front panel section of the image forming apparatus 1, and includes buttons, a compact display, and the like that are used by a user to operate the image forming apparatus 1. The communication interface 15 is located inside the image forming apparatus 1, and includes a communication circuit for communicably connecting the image forming apparatus 1 and the terminal device. The storage unit 16 comprises, for example, a nonvolatile storage device or memory device, such as a hard disk or a flash memory, which is capable of retaining information for the long term.

The printing unit 12 includes a paper sheet transport mechanism 28 for rotating a transport roller 21 to thereby transport each sheet of paper P located in the sheet feeding cassettes 22 along a paper sheet transport path 23 formed in the internal portion of the image forming apparatus 1, supplying the sheets of paper P successively to a print engine 24, a transferring section 25, and a fixing section 26, and delivering from a delivery section 27 the sheets of paper P after the printing process is completed by the print engine 24, the transferring section 25, and the fixing section 26.

The paper sheet transport mechanism 28 includes a double-sided printing unit 31 for performing double-sided printing. The double-sided printing unit 31 has a suitable structure for achieving high-speed double-sided printing for performing double-sided printing on three sheets of paper P in parallel (see FIG. 5). That is, the double-sided printing unit 31 includes a branch section 32, a paper sheet transport path 33 for the double-sided printing, an intermediate tray 34, a switchback mechanism 35, and a paper sheet reversing device 36. The branch section 32 is located between a paper sheet delivery side of the fixing section 26 and the delivery section 27, and leads the sheet of paper P to the paper sheet transport path 33 of the double-sided printing unit 31. The intermediate tray 34 is located midway through the paper sheet transport path 33, and temporarily stores thereon one sheet of paper P led by the branch section 32. The switchback mechanism 35 reverses a transport direction of the sheet of paper P stored on the intermediate tray 34, and again leads the sheet of paper P to the paper sheet transport path 33. The paper sheet reversing device 36 reverses the surfaces of the sheet of paper P again, led by the switchback mechanism 35 to the paper sheet transport path 33, and supplies the sheet of paper P to the print engine 24. Note that a known structure related to the double-sided printing may be used as the double-sided printing unit 31.

FIG. 2 illustrates an internal configuration of the control unit 13 and the like. As illustrated in FIG. 2, the control unit 13 includes a central processing unit (CPU) 41, a read only memory (ROM) 42, and a random access memory (RAM) 43. The ROM 42 stores therein a computer program for causing the control unit 13 to function as a job receiving unit 45 and a printing control unit 46, which are described later. The CPU 41 reads the computer program from the ROM 42, and executes the computer program to thereby cause the control unit 13 to function as the job receiving unit 45 and the printing control unit 46. The RAM 43 is used as a work memory or the like by the CPU 41 executing the computer program.

The job receiving unit 45 receives a single-sided printing job or a double-sided printing job that has been input by the user through an operation of the operation unit 14 or a transmission from the terminal device, and stores the received job into the RAM 43. The single-sided printing job is a job instruction to perform printing on only the front side of the sheet of paper P. Meanwhile, the double-sided printing job is a job instruction to perform printing on both the front and back sides of the sheet of paper P. Note that the job receiving unit 45 is a specific example of a job receiving unit.

The printing control unit 46 controls the printing unit 12 and the like according to the job received by the job receiving unit 45. According to the manner in which a plurality of jobs that have been continuously received by the job receiving unit 45, the printing control unit 46 selects from the group consisting of the single-sided printing control, normal double-sided printing control, high-speed double-sided printing control, and mixed printing control, and executes the selected printing control. Note that the printing control unit 46 is a specific example of a high-speed double-sided printing control unit and a mixed printing control unit. The job receiving unit 45 and the printing control unit 46 are described in detail later with reference to FIG. 10.

FIGS. 3 to 6 each illustrate a double-sided printing method. The double-sided printing method is a method of performing printing on the front and back of the sheet of paper P. FIG. 3 illustrates normal double-sided printing. Normal double-sided printing is a method of performing printing on the front side and back side of the sheet of paper P at normal speed. In normal double-sided printing, printing on the back side of the sheet of paper and printing on the front side of the same sheet of paper are continuously performed to complete the double-sided printing on a sheet by sheet basis. That is, in normal double-sided printing, as illustrated in FIG. 3, double-sided printing is performed by first printing an image of a second page on a back side (first printing surface) of a first sheet of paper P, then printing an image of a first page on a front side (last printing surface) of the first sheet of paper P, then printing an image of a fourth page on a back side of a second sheet of paper P, and then printing an image of a third page on a front side of the second sheet of paper P.

FIGS. 4 to 6 each illustrate high-speed double-sided printing. High-speed double-sided printing is a method of performing the double-sided printing on the front side and the back side of the sheet of paper P at higher speed than normal double-sided printing. In high-speed double-sided printing, printing on the back side or the front side of another sheet of paper is performed between the printing on the back side of one sheet of paper and the printing on the front side of the one sheet of paper to thereby perform double-sided printing on two or more sheets of paper in parallel.

FIG. 4 illustrates high-speed double-sided printing for performing double-sided printing on two sheets of paper P in parallel. In high-speed double-sided printing, double-sided printing on two sheets of paper is performed in parallel by performing the printing on two back sides of one sheet of paper and printing on the front side of the one sheet of paper between which printing on the front side of the first preceding sheet of paper and the back side of the first succeeding sheet of paper is performed. That is, in high-speed double-sided printing, as illustrated in FIG. 4, the image of the second page is first printed on the back side of the first sheet of paper P. Then, the image of the fourth page is printed on the back side of the second sheet of paper P. Then, the image of the first page is printed on the front side of the first sheet of paper P. Then, the image of the third page is printed on the front side of the second sheet of paper P. Then, the image of the sixth page is printed on the back side of the third sheet of paper P. Double-sided printing can be performed by such a procedure.

FIG. 5 illustrates high-speed double-sided printing method for performing double-sided printing on three sheets of paper P in parallel. In this high-speed double-sided printing method, double-sided printing on three sheets of paper is performed in parallel by printing on the back side of one sheet of paper and printing on the front side of the one sheet of paper, between which printing on the front side of the first preceding sheet of paper and the back side of the first succeeding sheet of paper is performed. That is, in the high-speed double-sided printing, as illustrated in FIG. 5, the image of the second page is first printed on the back side of the first sheet of paper P. Then, the image of the fourth page is printed on the back side of the second sheet of paper P. Then, the image of the first page is printed on the front side of the first sheet of paper P. Then, the image of the sixth page is printed on the back side of the third sheet of paper P. Then, the image of the third page is printed on the front side of the second sheet of paper P. Then, the image of the sixth page is printed on the back side of the third sheet of paper P. Thus, double-sided printing can be performed by such a procedure. According to the high-speed double-sided printing method, the double-sided printing process can be performed at higher speeds than the high-speed double-sided printing illustrated in FIG. 4.

FIG. 6 illustrates high-speed double-sided printing for performing the double-sided printing on five sheets of paper P in parallel. In the high-speed double-sided printing method, double-sided printing on five sheets of paper is performed in parallel by printing on the back side of one sheet of paper and the printing on the front side of the same sheet of paper between which printing on the front side of the second preceding sheet of paper, the back side of the first succeeding sheet of paper, the front side of the first preceding sheet of paper, and the back side of the second succeeding sheet of paper is performed. That is, in the high-speed double-sided printing method, as illustrated in FIG. 6, the image of the second page is first printed on the back side of the first sheet of paper P. Then, the image of the fourth page is printed on the back side of the second sheet of paper P. Then, the image of the sixth page is printed on the back side of the third sheet of paper P. Then, the image of the first page is printed on the front side of the first sheet of paper P. Then, the image of the eighth page is printed on the back side of the fourth sheet of paper P. Then, the image of the third page is printed on the front side of the second sheet of paper P. Then, the image of the tenth page is printed on the back side of the fifth sheet of paper P. Then, the image of the fifth page is printed on the front side of the third sheet of paper P. Double-sided printing can be performed by such a procedure. According to the high-speed double-sided printing method, the double-sided printing process can be performed at higher speeds than the high-speed double-sided printing process illustrated in FIG. 5.

FIGS. 7 to 9 each illustrate a mixed printing method. Mixed printing is a method of continuously realizing single-sided printing and double-sided printing at high speed. In mixed printing, the double-sided printing on two or more sheets of paper is performed in parallel by performing the printing on the front and back surface of one sheet of paper and the printing on the front side of the one paper sheet between which printing on the back side or the front side of another sheet of paper is performed. During the double-sided printing, when the printing process corresponding to the single-sided printing job is performed, printing of a blank page is performed on either the back side or the front side of the sheet of paper.

FIG. 7 illustrates mixed printing based on the high-speed double-sided printing method for performing double-sided printing on two sheets of paper r in parallel. In mixed printing, the double-sided printing on two sheets of paper is performed in parallel by performing printing on the back side of one sheet of paper and printing on the front side of the one sheet of paper between which printing on the front side of the first preceding sheet of paper and the back side of the first succeeding sheet of paper is performed, and during the double-sided printing, when the printing corresponding to the single-sided printing job is performed, printing of a blank page is performed on the back side of the sheet of paper. For example, in a situation where the job receiving unit 45 performs the mixed printing including: the double-sided printing of four pages corresponding to a first double-sided printing job that was initially received; the single-sided printing of one page corresponding to the single-sided printing job that was subsequently received to the first double-sided printing job; and the double-sided printing of four pages corresponding to a second double-sided printing job that was subsequently received to the single-sided printing job, as illustrated in FIG. 7, the image of the second page related to the first double-sided printing job is first printed on the back side of the first sheet of paper P. Then, the image of the fourth page, related to the first double-sided printing job is printed on the back side of the second sheet of paper P. Then, the image of the first page, related to the first double-sided printing job is printed on the front side of the first sheet of paper P. Then, the image of the third page, related to the first double-sided printing job is printed on the front side of the second sheet of paper P. Then, the blank page is printed on the back side of the third sheet of paper P. Then, the image of the second page, related to the second double-sided printing job is printed on the back side of the fourth sheet of paper P. Then, the image of the first page, related to the single-sided printing job is printed on the front side of the third sheet of paper P. Then, the image of the first page, related to the second double-sided printing job is printed on the front side of the fourth sheet of paper P. Then, the image of the fourth page, related to the second double-sided printing job is printed on the back side of the fifth sheet of paper P. Then, the image of the third page, related to the second double-sided printing job is printed on the front side of the fifth sheet of paper P.

FIG. 8 illustrates mixed printing based on the high-speed double-sided printing method for performing double-sided printing on three sheets of paper P in parallel. In mixed printing, the double-sided printing on three sheets of paper is performed in parallel by performing the printing on the back and front side of one sheet of paper between which printing on the front side of the first preceding sheet of paper and the back side of the first succeeding sheet of paper is performed, and during execution of the double-sided printing, when the printing corresponding to the single-sided printing job is performed, printing of a blank page is performed on the back side of the sheet of paper. For example, in a situation where the job receiving unit 45 performs the mixed printing including: the double-sided printing of four pages corresponding to a first double-sided printing job that was initially received; the single-sided printing of one page corresponding to the single-sided printing job that was subsequently received to the first double-sided printing job; and the double-sided printing of four pages corresponding to a second double-sided printing job that was subsequently received to the single-sided printing job, as illustrated in FIG. 8, the image of the second page, related to the first double-sided printing job is first printed on the back side of the first sheet of paper P. Then, the image of the fourth page, related to the first double-sided printing job is printed on the back side of the second sheet of paper P. Then, the image of the first page, related to the first double-sided printing job is printed on the front side of the first sheet of paper P. Then, the blank page is printed on the back side of the third sheet of paper P. Then, the image of the third page, related to the first double-sided printing job is printed on the front side of the second sheet of paper P. Then, the image of the second page, related to the second double-sided printing job is printed on the back side of the fourth sheet of paper P. Then, the image of the first page, related to the single-sided printing job is printed on the front side of the third sheet of paper P. Then, the image of the fourth page, related to the second double-sided printing job is printed on the back side of the fifth sheet of paper P. Then, the image of the first page, related to the second double-sided printing job is printed on the front side of the fourth sheet of paper P. Then, the image of the third page, related to the second double-sided printing job is printed on the front side of the fifth sheet of paper P. According to this mixed printing method, the mixed printing can be performed at higher speeds than the mixed printing method illustrated in FIG. 7.

FIG. 9 illustrates mixed printing based on a high-speed double-sided printing method or performing double-sided printing on five sheets of paper P in parallel. In the mixed printing method, the double-sided printing on five sheets of paper is performed in parallel by performing the printing on the back side of one sheet of paper and the printing on the front side of the one sheet of paper between which printing on the front side of the second preceding sheet of paper, the back side of the first succeeding sheet of paper, the front side of the first preceding sheet of paper, and the back side of the second succeeding sheet of paper is performed, and during execution of the double-sided printing, when the printing corresponding to the single-sided printing job is performed, printing of a blank page is performed on the back side of the sheet of paper. For example, in a situation where the job receiving unit 45 performs mixed printing including: double-sided printing of four pages corresponding to a first double-sided printing job that was initially received; the single-sided printing of one page corresponding to the single-sided printing job that was subsequently received to the first double-sided printing job; and the double-sided printing of four pages corresponding to a second double-sided printing job that was subsequently received to the single-sided printing job, as illustrated in FIG. 9, the image of the second page related to the first double-sided printing job is first printed on the back side of the first sheet of paper P. Then, the image of the fourth page, related to the first double-sided printing job is printed on the back side of the second sheet of paper P. Then, the blank page is printed on the back side of the third sheet of paper P. Then, the image of the first page, related to the first double-sided printing job is printed on the front side of the first sheet of paper P. Then, the image of the second page, related to the second double-sided printing job is printed on the back side of the fourth sheet of paper P. Then, the image of the third page, related to the first double-sided printing job is printed on the front side of the second sheet of paper P. Then, the image of the fourth page, related to the second double-sided printing job is printed on the back side of the fifth sheet of paper P. Then, the image of the first page, related to the single-sided printing job is printed on the front side of the third sheet of paper P. Then, the image of the first page, related to the second double-sided printing job is printed on the front side of the fourth sheet of paper P. Then, the image of the third page, related to the second double-sided printing job is printed on the front side of the fifth sheet of paper P. According to the mixed printing method, the mixed printing process can be performed at higher speeds than the mixed printing method illustrated in FIG. 8.

FIGS. 4 to 9 are used hereinabove to describe three types of high-speed double-sided printing and three types of the mixed printing, but other types of the high-speed double-sided printing and the mixed printing are possible. For example, by further increasing the number of sheets of paper for which the printing is performed between the printing on the back side of one sheet of paper and the printing on the front side of the one sheet of paper, it is possible to realize high-speed double-sided printing and mixed printing at higher speeds than high-speed double-sided printing and mixed printing that are described above. To actually achieve such high-speed double-sided printing and mixed printing, it is necessary to locate inside the image forming apparatus a double-sided printing unit having a suitable structure for performing each of the types of high-speed double-sided printing or each of the types of the mixed printing. Note that the structure and the operation of the double-sided printing unit for performing each of the types of high-speed double-sided printing are known, and therefore the description thereof is omitted here. Further, each of the types of mixed printing can be achieved by using a known double-sided printing unit structure for performing each of the types of high-speed double-sided printing.

The image forming apparatus 1 according to this embodiment includes the double-sided printing unit 31 having a suitable structure for performing the high-speed double-sided printing method illustrated in FIG. 5 and the mixed printing method illustrated in FIG. 8 (see FIG. 1). Therefore, the image forming apparatus 1 according to this embodiment can perform the high-speed double-sided printing method illustrated in FIG. 5 and the mixed printing method illustrated in FIG. 8 in addition to single-sided printing and normal double-sided printing.

FIG. 10 illustrates an embodiment of the operation of the image forming apparatus 1. As illustrated in FIG. 10, during the operation of the image forming apparatus 1, the job receiving unit 45 constantly waits for a job to be inputted by the user through the operation of the operation unit 14 or a job to be transmitted from the terminal device (Step S1: job receiving step). When the job receiving unit 45 receives a job (Step S1: YES), the job receiving unit 45 stores the job in the RAM 43 of the control unit 13 (Step S2).

Meanwhile, the printing control unit 46 operates in parallel with the job receiving unit 45. The printing control unit 46 determines whether or not there is a job stored in the RAM 43 of the control unit 13 (Step S3). When there is a stored job, the job in the RAM 43 is read. When the job receiving unit 45 receives a plurality of jobs, and the jobs will be stored in the RAM 43, the printing control unit 46 will then examine the manner in which that plurality of jobs that has been received.

As a result of the examination, if the jobs that have been received by the job receiving unit 45 include only single-sided printing jobs (Step S3: A), the printing control unit 46 executes the single-sided printing control for performing the single-sided printing on the front side of the sheet of paper P (Step S4). Therefore, the single-sided printing according to the plurality of single-sided printing jobs that have been received by the job receiving unit 45 is performed.

Meanwhile, if the plurality of jobs that have been received by the job receiving unit 45 include only double-sided printing jobs (Step S3: B), the printing control unit 46 executes the high-speed double-sided printing control for performing high-speed double-sided printing illustrated in FIG. 5 (Step S5). Accordingly, high-speed double-sided printing according to the plurality of double-sided printing jobs that have been received by the job receiving unit 45 is performed.

At this time, the printing control unit 46 continuously performs high-speed double-sided printing according to the plurality of double-sided printing jobs that have been continuously received by the job receiving unit 45 as if high-speed double-sided printing according to one double-sided printing job were performed. That is, when the printing method shifts from a first high-speed double-sided printing according to the first double-sided printing job to a second high-speed double-sided printing according to the subsequent second double-sided printing job, the printing control unit 46 prints on the back side of the sheet of paper P for the second high-speed double-sided printing in a state in which the sheet of paper P for the first high-speed double-sided printing is stored on the intermediate tray 34.

On the other hand, if the plurality of jobs that have been continuously received by the job receiving unit 45 have single-sided printing jobs and double-sided printing jobs coexisting thereamong, so as to satisfy a mixed printing control condition described as follows (Step S3: C), the printing control unit 46 executes the mixed printing control for performing mixed printing as illustrated in FIG. 8 (Step S6). Accordingly, mixed printing according to the plurality of jobs that have been received by the job receiving unit 45 is performed.

The mixed printing control condition is that a job execution order received by the job receiving unit 45 is for (1) one or more successive double-sided printing jobs, (2) one or more successive single-sided printing jobs, and (3) one or more successive double-sided printing jobs, and that the total number of pages for which printing is to be performed according to the one or more successive single-sided printing jobs is less than 2 (note that if the mixed printing control condition is satisfied, "one or more successive single-sided printing jobs" means one single-sided printing job).

When mixed printing is performed, the printing control unit 46 continuously performs mixed printing according to the plurality of jobs that have been received by the job receiving unit 45 as if high-speed double-sided printing according to one double-sided printing job was performed. That is, the printing control unit 46 handles the single-sided printing job as a double-sided printing job with a blank page set to be printed on the back side.

When the printing method shifts from printing corresponding to the first double-sided printing job to that corresponding to the subsequent single-sided printing job, the printing control unit 46 prints a blank page on the back side of the sheet of paper P for mixed printing corresponding to the single-sided printing job with the sheet of paper P for the printing corresponding to the first double-sided printing job being stored on the intermediate tray 34. When the printing method shifts from printing corresponding to the single-sided printing job to that corresponding to the subsequent second double-sided printing job, the printing control unit 46 prints on the back side of the sheet of paper P for printing the second double-sided printing job with the sheet of paper P for the printing corresponding to the single-sided printing job being stored on the intermediate tray 34.

In the mixed printing, print data for forming the blank page printed on the back side of the sheet of paper P for printing the corresponding single-sided printing job is previously generated, for example, for each size of the sheet of paper, and is prestored in the ROM 42 of the control unit 13 or the storage unit 16, such as on a hard disk in the image forming apparatus 1. In performing the mixed printing control, the printing control unit 46 reads the print data for forming the blank page from the ROM 42 of the control unit 13, or the storage unit 16, creates a blank page (blank image) based on the read print data, and prints the blank page on the back side of the sheet of paper P for the single-sided printing job.

On the other hand, if the plurality of jobs that have been received by the job receiving unit 45 include single-sided printing jobs and double-sided printing jobs coexist thereamong so as to not satisfy the above-described mixed printing control condition, or if the job received by the job receiving unit 45 is a single job (Step S3: D), the printing control unit 46 performs single-sided printing control, normal double-sided printing control, or high-speed double-sided printing control according to the received plurality of jobs or the received single job (Step S7). In this case, if the number of pages for which the double-sided printing is to be continuously performed is 2 or less, the printing control unit 46 executes the normal double-sided printing control for performing the normal double-sided printing illustrated in FIG. 3, and if the number of pages for which the double-sided printing is to be continuously performed is 3 or more, executes the high-speed double-sided printing control for performing the high-speed double-sided printing illustrated in FIG. 5.

After the printing control of Steps S4 to S7 is completed, the procedure for the process performed by the printing control unit 46 returns to Step S3.

As described above, the image forming apparatus 1 performs the mixed printing if the jobs that have been received have job instructions to perform double-sided printing and job instructions to perform single-sided printing coexisting thereamong, and if the manner in which the plurality of jobs that were received satisfies the above-described mixed printing control condition. As apparent from a comparison between FIGS. 8 and 5, the mixed printing is performed based on high-speed double-sided printing. The mixed printing process is the same as the high-speed double-sided printing process in terms of, specifically, the transport method for the sheet of paper P, more specifically, an order reversing the direction of the sheet of paper P and sides thereof, a method of storing the sheets of paper P on the intermediate tray 34, an order supplying the sheets of paper P to the print engine 24, and an order printing respective pages on the sheets of paper P. Therefore, the mixed printing is as fast as high-speed double-sided printing. Accordingly, the image forming apparatus 1 allows printing to be performed at high speeds if the above-described mixed printing control condition is met even in the situation where the plurality of jobs that have been received have job instructions to perform the double-sided printing and job instructions to perform single-sided printing coexisting thereamong.

Note that the image forming apparatus 1 described above uses high-speed double-sided printing as illustrated in FIG. 5 and mixed printing as illustrated in FIG. 8 as the methods for high-speed double-sided printing and mixed printing, but the present invention is not limited thereto. The image forming apparatus 1 uses high-speed double-sided printing as illustrated in FIG. 4 and mixed printing as illustrated in FIG. 7, high-speed double-sided printing as illustrated in FIG. 6 and mixed printing as illustrated in FIG. 9, or other such high-speed double-sided printing and mixed printing.

The image forming apparatus 1 described above performs the mixed printing control when the execution order, of the plurality of jobs, received by the job receiving unit 45 is (1) one or more successive double-sided printing jobs, (2) one or more successive single-sided printing jobs, and (3) one or more successive double-sided printing jobs, but the present invention is not limited thereto. For example, the image forming apparatus 1 may perform mixed printing control when the execution order, of the plurality of jobs, received by the job receiving unit 45 is (1) one or more successive double-sided printing jobs and (2) one or more successive single-sided printing jobs. Alternatively, the image forming apparatus 1 may perform mixed printing control when the execution order, of the plurality of jobs, received by the job receiving unit 45 is (1) one or more successive single-sided printing jobs and (2) one or more successive double-sided printing jobs. Further, the image forming apparatus 1 may perform mixed printing control when one or more successive single-sided printing jobs and one or more successive double-sided printing jobs are executed alternately. It is possible to effectively achieve printing at higher speeds by executing the mixed printing control when the execution order, of the plurality of jobs, received by the job receiving unit 45 is (1) one or more successive double-sided printing jobs, (2) one or more successive single-sided printing jobs, and (3) one or more successive double-sided printing jobs.

The image forming apparatus 1 described above executes the mixed printing control when the total number of pages for which the printing is to be performed, according to one or more successive single-sided printing jobs, which are included in the plurality of jobs that have been received by the job receiving unit 45, is less than 2, but the present invention is not limited thereto. The image forming apparatus 1 may perform the mixed printing control when the total number of pages is less than 3, less than 4, or less than a predetermined number (equal to or larger than 4) of pages. It is possible to effectively realize printing at higher speeds by performing mixed printing control when the total number of pages to be printed according to one or more successive single-sided printing jobs is less than 2.

In the situation where the printing, according to the single-sided printing job, is performed by mixed printing control, a blank page is printed on the back side of the sheet of paper P before the image of the first page related to the single-sided printing job is printed on the front side of the sheet of paper P. Meanwhile, in the situation where the printing according to the single-sided printing job is performed by single-sided printing control, the image of the first page related to the single-sided printing job is merely printed on the front side of the sheet of paper P. As a result, in terms of only the printing according to the single-sided printing job, the printing performed by the mixed printing control takes a longer time than printing performed by single-sided printing control. Nonetheless, printing performed by mixed printing control is effective. This is because the operation of the high-speed double-sided printing corresponding to double-sided printing jobs before and after the single-sided printing job is continuously performed without being reset by printing corresponding to a single-sided printing job, which reduces the time necessary for the overall printing according to the respective jobs. In turn, if the number of pages for which the printing is to be performed according the single-sided printing job is large, the time necessary for the printing, according to the single-sided printing job by mixed printing control, may be longer than the time as reduced by continuously performing the operation of the high-speed double-sided printing corresponding to the double-sided printing jobs before and after the single-sided printing job. This makes it impossible to achieve higher speed printing performed by the mixed printing control. Therefore, it becomes an issue as to how the mixed printing control condition should be set, that is, which upper limit value should be set for the total number of pages for which the printing is to be performed according to one or more successive single-sided printing jobs, in order to effectively achieve printing by the mixed printing control at higher speeds. In this regard, if the total number of pages for which printing is to be performed according to one or more successive single-sided printing jobs is less than 2, the time required for printing according to the single-sided printing job by the mixed printing control is shorter than the time required by continuously performing the operation of the high-speed double-sided printing corresponding to the double-sided printing jobs before and after the single-sided printing job, which achieves the printing performed by the mixed printing control at higher speed.

Hereinafter, a description of another embodiment of the present invention will be provided. In the same manner as the image forming apparatus according to the embodiment, as illustrated in FIG. 1, an image forming apparatus according to the embodiment is a multifunction peripheral having a copier function and a printer function, and includes a document reading mechanism 11, a printing unit 12, a control unit 13, an operation unit 14, a communication interface 15, and a storage unit 16. These components are the same as those of the previous embodiment.

The image forming apparatus 1 includes a plurality of sheet feeding cassettes 22, and a plurality of kinds of sheets of paper P, that differ in size or orientation thereof, are located in each of the sheet feeding cassettes 22. Note that FIG. 1 illustrates only three sheet feeding cassettes 22, but the image forming apparatus 1 may be provided with a larger number of sheet feeding cassettes.

FIG. 11 illustrates an internal configuration of the control unit 13 and the like. As illustrated in FIG. 11, the control unit 13 includes a CPU 41, a ROM 42, and a RAM 43. The ROM 42 stores therein a computer program for causing the control unit 13 to function as a job receiving unit 45 and a printing control unit 46, which are described hereinafter. The CPU 41 reads the computer program from the ROM 42, and executes the computer program to thereby cause the control unit 13 to function as the job receiving unit 45 and the printing control unit 46. The RAM 43 is used as a work memory or the like by the CPU 41 executing the computer program.

The job receiving unit 45 receives a job that has been inputted by the user through an operation of the operation unit 14 or transmission from the terminal device, and stores the received job into the RAM 43. Note that the job receiving unit 45 is a specific example of a printing request job receiving unit.

The jobs are classified into single-sided printing jobs and the double-sided printing jobs. The single-sided printing job is a job instruction to perform single-sided printing, that is, a job instruction to perform printing on only the front side of the sheet of paper P. Meanwhile, the double-sided printing job is a job instruction to perform the double-sided printing, that is, a job instruction to perform printing on the front side and the back side of the sheet of paper P. Note that the double-sided printing job is a specific example of a double-sided printing request.

The job contains specification information specifying the size and orientation of the sheet of paper P on which the printing is to be performed. The size and the orientation of the sheet of paper P are described later by referring to FIG. 12.

The printing control unit 46 controls the printing unit 12 and the like according to the job received by the job receiving unit 45. The printing control unit 46 includes a control command unit 46A and a control execution unit 46B. The control command unit 46A selects a printing method (single-sided printing, normal double-sided printing, first high-speed double-sided printing, or second high-speed double-sided printing) according to which the printing unit 12 is to be controlled to perform printing, and transmits to the control execution unit 46B a command instructing to perform the printing based on the selected printing method. The control execution unit 46B controls the printing unit 12 and the like according to the command transmitted from the control command unit 46A, and executes the printing based on the printing method selected by the control command unit 46A.

Specific description is made of a situation where the job receiving unit 45 receives a double-sided printing job. The control command unit 46A selects the double-sided printing method corresponding to the size and orientation of the sheet of paper P which is specified by the specification information contained in double-sided printing job received by the job receiving unit 45. And the control command unit 46A transmits to the control execution unit 46B a command instructing to perform double-sided printing based on the selected double-sided printing method. The control execution unit 46B controls the printing unit 12 and the like according to the command transmitted from the control command unit 46A, and performs double-sided printing based on the double-sided printing method selected by the control command unit 46A.

Even in a situation where mutually different sizes and orientations of the sheet of paper P are specified by respective specification information items contained in a plurality of double-sided printing requests continuously received by the job receiving unit 45, if the sizes and orientations of the sheet of paper P specified by those specification information items correspond to a common high-speed double-sided printing method, the control command unit 46A selects the common high-speed double-sided printing method. Then, the control command unit 46A transmits to the control execution unit 46B a command instruction to continuously perform the high-speed double-sided printing according to the plurality of double-sided printing requests based on the selected common high-speed double-sided printing method. The control execution unit 46B controls the printing unit 12 and the like according to the above-described command to continuously perform the high-speed double-sided printing selected by the control command unit 46A. The job receiving unit 45 and the printing control unit 46 are described in detail later by using FIG. 13.

FIG. 12 illustrates a printing control table. Recorded in a printing control table 51 is a correspondence relationship between the size and the orientation of the sheet of paper P and the double-sided printing method. Specifically, the relationship between an identification number assigned to each combination of the size and orientation of the sheet of paper P and an identification number assigned to each double-sided printing method is recorded. For example, the identification number "11" of the size and orientation of the sheet of paper P (A4, landscape) is in the correspondence relationship with the identification number "2" of the double-sided printing method (second high-speed double-sided printing method).

Herein, the first and second high-speed double-sided printing methods are specifically the high-speed double-sided printing methods illustrated in, for example, FIGS. 4 to 6. Based on the correspondence relationship between the size and the orientation of the sheet of paper P and the double-sided printing method recorded in the printing control table 51, the control command unit 46A selects the double-sided printing method corresponding to the size and orientation of the sheet of paper P specified by the specification information contained in the double-sided printing job. For example, the control command unit 46A selects the second high-speed double-sided printing method if the size and orientation of the sheet of paper P specified by the specification information contained in the double-sided printing job is "A4, landscape". The printing control table 51 is stored in, for example, the storage unit 16.

FIG. 13 illustrates an embodiment of the operation of the image forming apparatus 1. During the operation of the image forming apparatus 1, the job receiving unit 45 waits for a job to be inputted by the user through operation of the operation unit 14 or a job to be transmitted from the terminal device (Step S11: printing request receiving step).

When the job receiving unit 45 receives a job (Step S11: YES), the printing control unit 46 operates as follows (Step S12 to Step S20: printing control step).

If the job that has been received by the job receiving unit 45 is a single-sided printing job (Step S12: NO), the control command unit 46A of the printing control unit 46 transmits to the control execution unit 46B a command instruction to perform single-sided printing. Subsequently, the control execution unit 46B performs single-sided printing according to the command transmitted from the control command unit 46A (Step S13). Note that if first or second high-speed double-sided printing is being currently performed by the printing unit 12 and the like, under the control of the control execution unit 46B based on the double-sided printing job that had been received by the job receiving unit 45 immediately before the currently-received job, single-sided printing based on the currently-received job is performed after the first or second high-speed double-sided printing is completed.

On the other hand, if the job that has been received by the job receiving unit 45 is the double-sided printing job (Step S12: YES), based on the correspondence relationship between the size and orientation of the sheet of paper P and the double-sided printing method which are recorded in the printing control table 51, the control command unit 46A selects the double-sided printing method corresponding to the size and the orientation of the sheet of paper P which is specified by the specification information contained in the double-sided printing job (Step S14).

If the double-sided printing method selected in Step S14 is normal double-sided printing (Step S15: NO), the control command unit 46A transmits to the control execution unit 46B a command instruction to perform normal double-sided printing. Subsequently, the control execution unit 46B performs normal double-sided printing according to the command transmitted from the control command unit 46A (Step S16). Note that the first or second high-speed double-sided printing is being currently performed by the printing unit 12 and the like, the normal double-sided printing based on the currently-received job is performed after the first or second high-speed double-sided printing is completed.

On the other hand, if the double-sided printing method selected in Step S14 is the first or second high-speed double-sided printing (Step S15: YES), the control command unit 46A subsequently examines whether or not the first or second high-speed double-sided printing is being performed by the printing unit 12 and the like under the control of the control execution unit 46B based on the double-sided printing job that had been received by the job receiving unit 45 immediately before the currently-received job (Step S17).

As a result of the examination, if the first or second high-speed double-sided printing is not being currently performed (to be specific, if the printing is not being performed, if the single-sided printing is being performed, or if the normal double-sided printing is being performed) (Step S17: NO), the control command unit 46A transmits to the control execution unit 46B a command instruction to perform the first or second high-speed double-sided printing selected in Step S14. According to the command, the control execution unit 46B performs the first or second high-speed double-sided printing separately (Step S18).

Meanwhile, as a result of the examination in Step S17, if the first or second high-speed double-sided printing being performed (Step S17: YES), the control command unit 46A determines whether or not the double-sided printing method (first or second high-speed double-sided printing) selected in Step S14 is common to the high-speed double-sided printing (first or second high-speed double-sided printing) that is being currently performed (Step S19).

As a result of the determination, the double-sided printing method selected in Step S14 is not common to the high-speed double-sided printing that is currently performed (Step S19: NO), the control command unit 46A transmits to the control execution unit 46B the command instruction to perform the first or second high-speed double-sided printing selected in Step S14. According to the command, the control execution unit 46B performs the first or second high-speed double-sided printing (Step S18). The high-speed double-sided printing is performed separately after high-speed double-sided printing that is being performed is completed.

Meanwhile, as a result of the determination in Step S19, if the double-sided printing method selected in Step S14 is common to the high-speed double-sided printing that is being performed (Step S19: YES), the control command unit 46A transmits to the control execution unit 46B a command instruction to continuously perform high-speed double-sided printing selected in Step S14 based on the double-sided printing job that has been received by the job receiving unit 45 in succession to the high-speed double-sided printing that is being performed. According to the command, the control execution unit 46B performs high-speed double-sided printing (Step S20). That is, the control execution unit 46B performs high-speed double-sided printing based on the double-sided printing job that had been received immediately before the currently-received job and the high-speed double-sided printing based on the double-sided printing job that has been received.

An example will be given, of a situation where the job that had been received immediately before the currently-received job is a double-sided printing job A instruction to perform double-sided printing of four pages on B5 sheets of paper P in landscape and where the currently-received job is a double-sided printing job B instruction to perform double-sided printing of six pages on A4 sheets of paper P in landscape. As illustrated in FIG. 9, the control execution unit 46B controls the printing unit 12 and the like to continuously perform the second high-speed double-sided printing based on the two double-sided printing jobs A and B that have been received. In this situation, when the printing method shifts from the second high-speed double-sided printing based on the double-sided printing job A to the second high-speed double-sided printing based on the double-sided printing job B, the printing unit 12 proceeds to printing the image of the second page related to the double-sided printing job B on the back side of the sheet of paper P of A4 in landscape so the sheet of paper P of B5 is in landscape, on which the image of the fourth page related to the double-sided printing job A has been printed on the back side, is stored on the intermediate tray 34. Therefore, while the printing method is shifting from the second high-speed double-sided printing based on the double-sided printing job A to the second high-speed double-sided printing based on the double-sided printing job B, an overlap between a sheet of paper reverse transport operating period and a printing operating period is maintained. As a result, the speed of two successive second high-speed double-sided printing operations, based on the two double-sided printing jobs A and B that have been continuously received, becomes as fast as that of one second high-speed double-sided printing operation based on a single double-sided printing job.

In each of Steps S13, S16, S18, and S20 described above, when the command has been transmitted from the control command unit 46A to the control execution unit 46B, the procedure for the process performed by the image forming apparatus 1 returns to Step S11 without waiting until the printing control is completed by the control execution unit 46B (in parallel with the execution of the printing control performed by the control execution unit 46B).

As has been described above, according to the image forming apparatus 1, even in a situation where a plurality of double-sided printing jobs instructions to perform double-sided printing, which are different from each other in size or orientation of the sheet of paper P, are received, the double-sided printing based on those double-sided printing jobs can be performed at higher speeds.

Note that FIG. 13 illustrates the operation of the image forming apparatus 1 using as an example of the situation where two double-sided printing jobs are continuously received by the job receiving unit 45, but the present invention is not limited thereto. Even when the job receiving unit 45 receives three or more double-sided printing jobs, if the sizes and orientations of the sheet of paper P specified by respective specification information items contained in those three or more double-sided printing jobs corresponds to a common double-sided printing method, it is possible to select the common double-sided printing method and continuously perform the double-sided printing according to the three or more double-sided printing jobs based on the selected common double-sided printing method.

FIG. 13 uses as an example of the situation where the high-speed double-sided printing that is being performed is continued while high-speed double-sided printing based on the job received by the job receiving unit 45 immediately before the currently-received job is being performed to thereby continuously perform high-speed double-sided printing based on those two jobs that had been received, but the present invention is not limited thereto. In a situation where the printing control unit 46 uses high-speed double-sided printing based on a plurality of double-sided printing jobs after the job receiving unit 45 receives the plurality of double-sided printing jobs instantaneously and continuously, it is possible to determine whether or not the high-speed double-sided printing methods related to the plurality of double-sided printing jobs are common to each other. If they are common, the printing control unit 46 continuously performs the high-speed double-sided printing based on the plurality of double-sided printing jobs.

There is a situation where, for example, a plurality of double-sided printing requests different from each other in size or orientation of the sheet of paper P are contained in one double-sided printing job. At this time, if the double-sided printing methods corresponding to the plurality of double-sided printing requests contained in the one double-sided printing job are common to each other, the common double-sided printing method may be selected. And the printing control unit 46 may continuously perform the double-sided printing according to the plurality of double-sided printing requests based on the selected common double-sided printing method.

Further, the above-described embodiments use as examples an image forming apparatus is a multifunction peripheral having a copier function and a printer function, but the present invention is not limited thereto. The present invention can be used with copiers, printers, and various kinds of devices having a double-sided printing function.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus, comprising:

a printing unit that prints on one side and/or another side of a sheet of paper;

a job receiving unit that receives a job instruction to perform single-sided printing and/or a job instruction to perform double-sided printing;

a high-speed double-sided printing control unit that performs a double-sided printing process on two or more sheets of paper in parallel by performing printing on the one side of one sheet of paper and printing on the another side of the one sheet of paper between which printing on the one side and/or the another side of another sheet of paper is performed; and a mixed printing control unit that performs, in a situation where the job instruction to perform the single-sided printing and the job instruction to perform the double-sided printing coexist in a plurality of jobs received by the job receiving unit, the double-sided printing process with a blank page set to be printed on one of the one side and the another side of the sheet of paper when printing corresponding to the job instruction to perform single-sided printing.

2. The image forming apparatus according to claim 1, wherein the mixed printing control unit performs the double-sided printing process on two or more sheets of paper in parallel by performing printing on the one side of one sheet of paper and printing on the another side of the one sheet of paper between which printing on the one side and/or the another side of another sheet of paper is performed.

3. The image forming apparatus according to claim 2, wherein the mixed printing control unit continuously performs the double-sided printing processing according to the plurality of jobs.

4. The image forming apparatus according to claim 1, further comprising a storage unit that stores therein print data corresponding to the blank page, wherein the mixed printing control unit reads the print data corresponding to the blank page from the storage unit to perform a printing process for the blank page.

5. The image forming apparatus according to claim 1, wherein only in a situation where the job instruction to perform the single-sided printing and the job instruction to perform the double-sided printing coexist in the plurality of jobs received by the job receiving unit and where an execution order of the plurality of jobs is: one or more successive job instruction to perform the double-sided printing; one or more successive job instruction to perform the single-sided printing; and one or more successive job instruction to perform the double-sided printing, the mixed printing control unit performs the double-sided printing process with a blank page set to be printed on one of the one side and the another side of the sheet of paper when printing corresponding to the job instruction to perform single-sided printing.

6. The image forming apparatus according to claim 5, wherein only in a situation where a total number of pages for which printing is performed according to the one or more successive job instructions to perform the single-sided printing is less than a predetermined number of pages, the mixed printing control unit performs the double-sided printing process with a blank page set to be printed on one of the one side and the another side of the paper sheet when printing corresponding to the job instruction to perform single-sided printing.

7. A printing control method of performing printing on one side and/or another side of a sheet of paper, comprising:

a job receiving step for receiving a job instruction to perform single-sided printing and/or a job instruction to perform double-sided printing;

a high-speed double-sided printing step for performing a double-sided printing process on two or more sheets of paper in parallel by printing on the one side of one sheet of paper and printing on the another side of the one sheet of paper between which printing on the one side and/or the another side of another sheet of paper is performed; and a mixed printing step for performing, in a situation where the job instruction to perform single-sided printing and the job instruction to perform the double-sided printing coexist in a plurality of jobs received in the job receiving step, the double-sided printing process with a blank page set to be printed on one of the one side and the another side of the sheet of paper when printing corresponding to the job instruction to perform single-sided printing.

8. The printing control method according to claim 7, wherein the mixed printing step comprises performing the double-sided printing processing on two or more sheets of paper in parallel by printing on the one side of one sheet of paper and printing on the another side of the one sheet of paper between which printing on the one side and/or the another side of another sheet of paper is performed.

9. The printing control method according to claim 8, wherein the mixed printing step comprises continuously performing double-sided printing process according to the plurality of jobs.

10. The printing control method according to claim 7, wherein the mixed printing step comprises reading prestored print data corresponding to the blank page to perform a printing process for the blank page.

11. The printing control method according to claim 7, wherein only in a situation where the job instruction to perform single-sided printing and the job instruction to perform double-sided printing coexist in the plurality of jobs received in the job receiving step and where an execution order of the plurality of jobs is: one or more successive job instructions to perform double-sided printing; one or more successive job instructions to perform single-sided printing; and one or more successive job instructions to perform double-sided printing, the mixed printing step comprises performing the double-sided printing process with a blank page set to be printed on one of the one side and the another side of the sheet of paper when printing corresponding to the job instruction to perform single-sided printing.

12. The printing control method according to claim 11, wherein only in a situation where a total number of pages for which printing is performed according to the one or more successive job instructions to perform single-sided printing is less than a predetermined number of pages, the mixed printing step comprises performing the double-sided printing process with a blank page set to be printed on one of the one side and the another side of the sheet of paper when printing corresponding to the job instructing to perform single-sided printing.

13. An image forming apparatus, comprising:

a printing unit that prints on a sheet of paper;

a job receiving unit that receives a job instruction to perform single-sided printing and a job instruction to perform double-sided printing;

a high-speed double-sided printing control unit that performs a double-sided printing process on two or more sheets of paper by performing printing on one side of one sheet of paper and printing on the other side of the one sheet of paper between which printing on the side and/or the other side of another sheet of paper is performed; and a mixed printing control unit that can perform the double-sided printing process with a blank page set to be printed on one of the one side and the another side of the sheet of paper when printing a job corresponding to a job instruction to perform single-sided printing.

* * * * *